US008714436B2

(12) United States Patent
Valot et al.

(10) Patent No.: US 8,714,436 B2
(45) Date of Patent: May 6, 2014

(54) TRAY, THE RIGIDITY OF WHICH IS IMPROVED, FOR TRANSPORTING AND DISPLAYING ITEMS SUCH AS YOGURT CONTAINERS

(75) Inventors: Denis Valot, Sassenay (FR); Jean-Yves Malnoy, Baudrieres (FR); Frederic Catherine, Saint Cyr (FR); Damien Tartre, L'Abergement Sainte Colombe (FR)

(73) Assignees: Societe Normande de Carton Ondule (FR); Papeteries D-Espaly (FR); Emballages Laurent SAS (FR); STE Mediterraneanne D'Emballages (FR)

( * ) Notice: Subject to any disclaimer, the term of this patent is extended or adjusted under 35 U.S.C. 154(b) by 0 days.

(21) Appl. No.: 13/565,938

(22) Filed: Aug. 3, 2012

(65) Prior Publication Data

US 2013/0056526 A1 Mar. 7, 2013

Related U.S. Application Data

(63) Continuation of application No. PCT/FR2011/050216, filed on Feb. 3, 2011.

(51) Int. Cl.
*B65D 21/032* (2006.01)
*B65D 5/28* (2006.01)

(52) U.S. Cl.
USPC ..... 229/109; 229/114; 229/190; 229/915; 229/918

(58) Field of Classification Search
USPC ..... 229/109, 113, 114, 186, 190, 191, 915, 229/916, 918, 919
See application file for complete search history.

(56) References Cited

U.S. PATENT DOCUMENTS

| | | | | |
|---|---|---|---|---|
| 1,911,952 | A * | 5/1933 | Halladay | 229/117.08 |
| 2,713,962 | A * | 7/1955 | Camp et al. | 229/120.1 |
| 2,822,119 | A * | 2/1958 | Van Dyke | 229/168 |

(Continued)

FOREIGN PATENT DOCUMENTS

| | | |
|---|---|---|
| EP | 337840 | 10/1989 |
| EP | 1243515 | 9/2002 |

(Continued)

*Primary Examiner* — Gary Elkins
(74) *Attorney, Agent, or Firm* — Thomas W. Ryan, III

(57) ABSTRACT

The invention relates to a tray for transporting and displaying items such as yogurt containers. The tray is of the type comprising a bottom wall (1), side walls (2, 3, 4, 5) perpendicular to the bottom (1) and side flaps (27) enabling the attachment of a first wall (2, 4) to the adjacent wall (3, 5), each flap being hingedly connected to the side edge of the first wall (2, 4) and attached to the following wall (3, 5). According to the invention, the hinged connection of the side flap (27) to the first wall is provided by an interface area (16) in the shape of a triangle the apex (17) of which points toward the free upper edge (31, 32) of the two consecutive side walls (2, 3, 4, 5) and the base (18) of which rests on the bottom wall (1), this triangular interface area (16) being slanted from its base (18) to the apex (17) toward the outside of the outline defined by the bottom wall (1). The invention can be used for trays for transporting products such as yogurt containers.

10 Claims, 5 Drawing Sheets

(56) References Cited

U.S. PATENT DOCUMENTS

| | | | | | |
|---|---|---|---|---|---|
| 3,462,065 | A | * | 8/1969 | Asman | 229/109 |
| 4,533,065 | A | * | 8/1985 | Chazal et al. | 229/109 |
| 5,028,000 | A | * | 7/1991 | Chabot et al. | 229/143 |
| 5,890,649 | A | * | 4/1999 | Baxter | 229/182.1 |
| 5,913,474 | A | * | 6/1999 | Chu | 229/167 |
| 6,158,652 | A | | 12/2000 | Ruiz et al. | |
| 6,508,395 | B2 | * | 1/2003 | McLeod | 229/174 |
| 2007/0090172 | A1 | | 4/2007 | Lyon et al. | |
| 2013/0037439 | A1 | | 2/2013 | Valot et al. | |

FOREIGN PATENT DOCUMENTS

| | | |
|---|---|---|
| FR | 2329523 | 5/1977 |
| FR | 2761340 | 10/1998 |
| FR | 2885881 | 11/2006 |
| FR | 2905937 | 3/2008 |
| FR | 2932461 | 12/2009 |
| JP | 9207940 | 8/1997 |
| WO | 2006039473 | 4/2006 |
| WO | 2011095742 | 8/2011 |
| WO | 2012010756 | 1/2012 |

* cited by examiner

TRAY, THE RIGIDITY OF WHICH IS IMPROVED, FOR TRANSPORTING AND DISPLAYING ITEMS SUCH AS YOGURT CONTAINERS

The invention relates to a tray for transporting and displaying items such as yogurt containers, obtained by folding from a single blank of corrugated cardboard having a rectangular shape of the type comprising a bottom wall and side walls joined by twos by a side attachment flap hingedly connected to the side edge of a first wall and attached over its entire length to the following wall.

Trays of this type having a general rectangular shape are already known.

These trays generally have insufficient vertical compressive strength and significant risk of an upper tray nesting within a lower tray.

What is more, when trays of this type comprise stacking lugs on each of the two shorter opposing walls, they have the drawback that the four lugs protrude beyond the rectangular outline of the initial blank, which constitutes a loss, for example, of 5% of corrugated cardboard material.

The objective of the invention is to remedy these drawbacks.

To achieve this objective, a tray according to the invention is characterized in that the hinged connection of the attachment flap to the first wall is provided by an interface area interposed between two consecutive side walls, this area being in the shape of a triangle, the apex of which points toward the free upper edge of the two consecutive side walls and the base of which rests on the base wall, the lateral sides of the triangle, each constituting hinge lines connecting to the two consecutive side walls, this triangular interface area being slanted from its base to the apex toward the outside of the outline defined by the bottom wall.

According to another feature, the tray comprises stacking lugs each extending above an interface area, the portion of the bottom wall on which the interface area rests being cut along the base of the interface area so as to leave a receiving space free for the stacking lug of an underlying tray.

According to yet another feature, each stacking lug is formed by a part of blank extending beyond the interface area on either side of the apex of this area, this part of the blank defining two perpendicular cardboard sections extending respectively in the extension of the two consecutive side walls between which the interface area is interposed.

Preferably, the free side edge of each section of a lug is parallel to the adjacent lateral side of the triangular interface area so as to enable application against the interface area of an identical tray above it within a stack.

Advantageously, the two shorter opposed side walls each comprise a cutout made in the lower part of the wall, the part of the wall disposed above the cutout serving as a grip strip for a user.

According to another feature, the grip strip of each short wall comprises a double thickness of blank derived from the folding of the flap for forming said side wall, which comprises a double fold line and the two parts of which extending from each side of this double line are provided with grip cutouts which match each other when this flap is folded onto itself.

In this case, the cutout is formed from the lower edge of the short wall.

According to another feature, the two longer opposed side walls of the tray are provided with second lugs extending on the plane of these longer walls and with complementary notches made directly below each lug within the side wall and the bottom wall.

Ideally, the longer walls comprise, over their length, openings for the visibility and aeration of the products.

According to one possible embodiment, the two longer walls, the side, flaps attaching the long walls to the short walls and the interface areas have the same height, height that is greater than that of the short walls.

According to another embodiment, a tray according to the invention is characterized in that it has a rectangular outline and in that the parts forming the lugs are included in this outline.

According to one feature of the invention, the tray is characterized in that the lug is formed on a side flap of a main flap forming a side wall which is hingedly connected to the main flap by an interface area such that it pivots in a position perpendicular to the main flap, and for attaching to the adjacent straightened wall flap, in that the cut inside edge of the side flap is slanted with respect to the fold line of the main flap such that the height of the side flap is greater at its end than the height in the interface area, and in that this interface area comprises a fold line device which ensures that this edge is parallel to the bottom wall when the side flap is in its abovementioned attachment position.

According to another feature of the invention, the tray is characterized in that the interface area is in the shape of a triangle the apex of which is located at the upper free edge of the flaps and the base of which is cut in the blank and adjacent to the bottom wall, and in that the lateral sides of the triangle constitute fold lines.

According to yet another feature of the invention, the tray is characterized in that the bottom wall is cut and rounded off in the abovementioned interface area.

According to yet another feature of the invention, the tray is characterized in that, in the blank, the upper outside edge of the side flap comprises at its end, a part in which this edge is in alignment with the upper edge of the main flap, whereas the remaining part of the upper edge is slanted and parallel to the lower edge of the flap, and in that, when the flap is in its abovementioned raised attachment position, the edge part is substantially in alignment with the outside edge of the straightened wall flaps, the upper edge portion constituting the stacking lug.

According to yet another feature of the invention, the tray is characterized in that the side flap comprises at least one notch cut in the lower edge which is disposed below the portion of the lug and forms, with a notch in the adjacent side wall flap and in the peripheral portion of the bottom wall, when the tray is assembled, a receiving space for the lug of a lower tray in a stack of trays.

According to yet another feature of the invention, the tray is characterized in that the side flaps are associated with main flaps which constitute the longest walls of the tray.

The invention will be more readily understood, and other objectives, features, details and advantages thereof will become more clearly evident in the explanatory description that follows, in which reference is made to the enclosed drawings provided solely for the sake of example and illustrating an embodiment of the invention, wherein.

Figure 5:
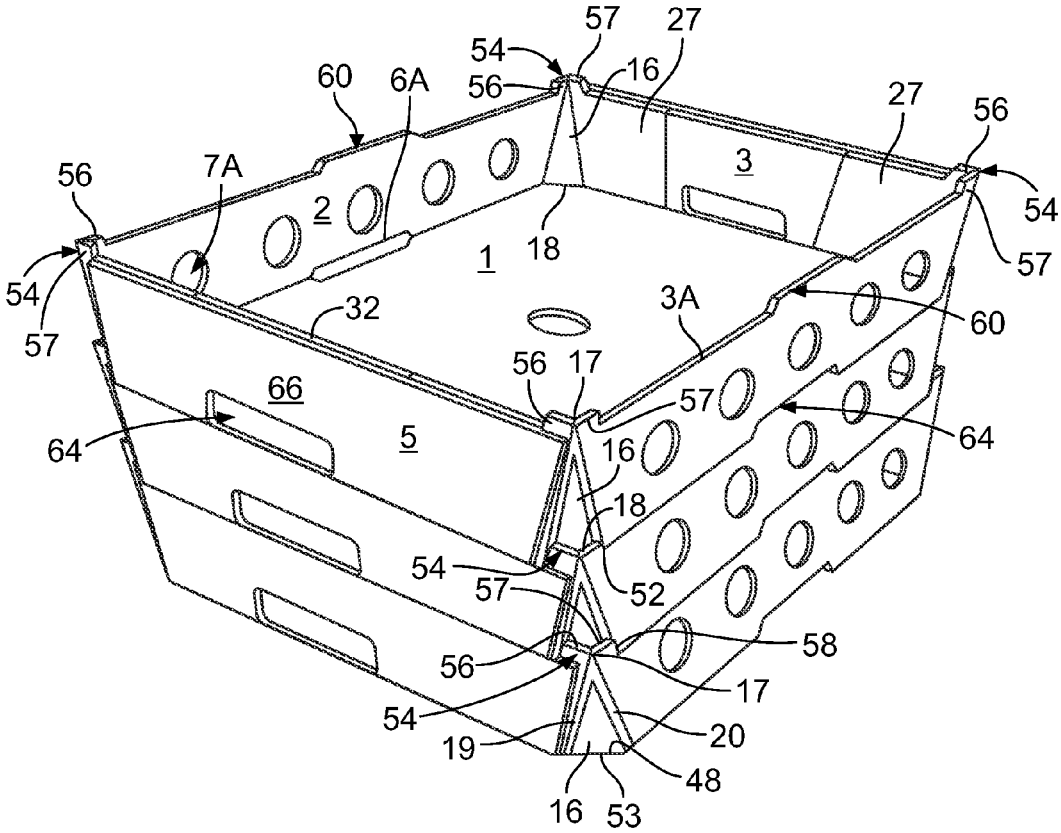
Figure 6:
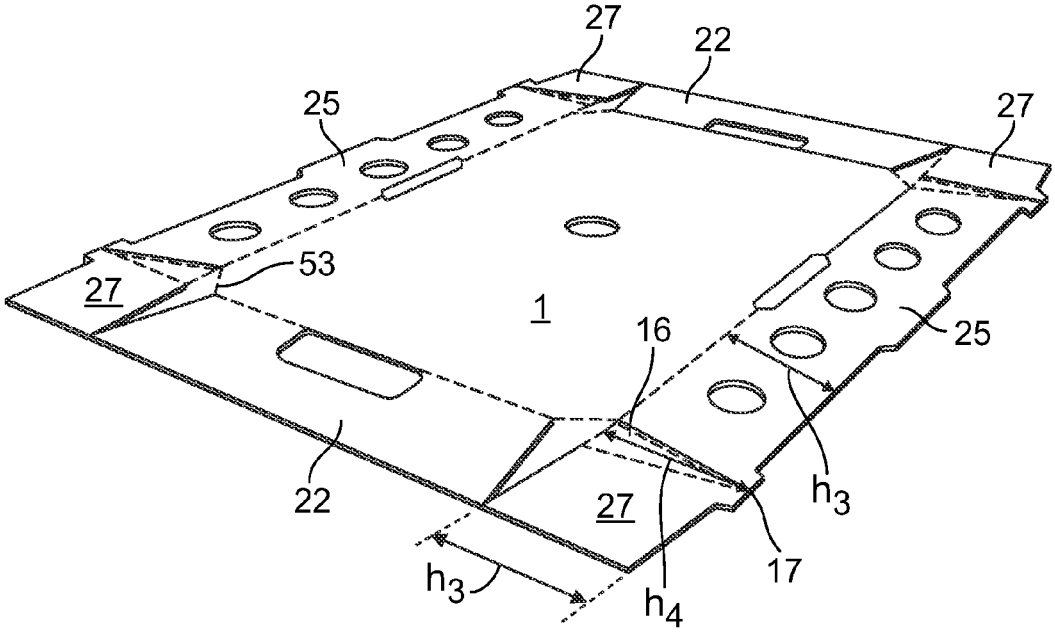
Figure 7:
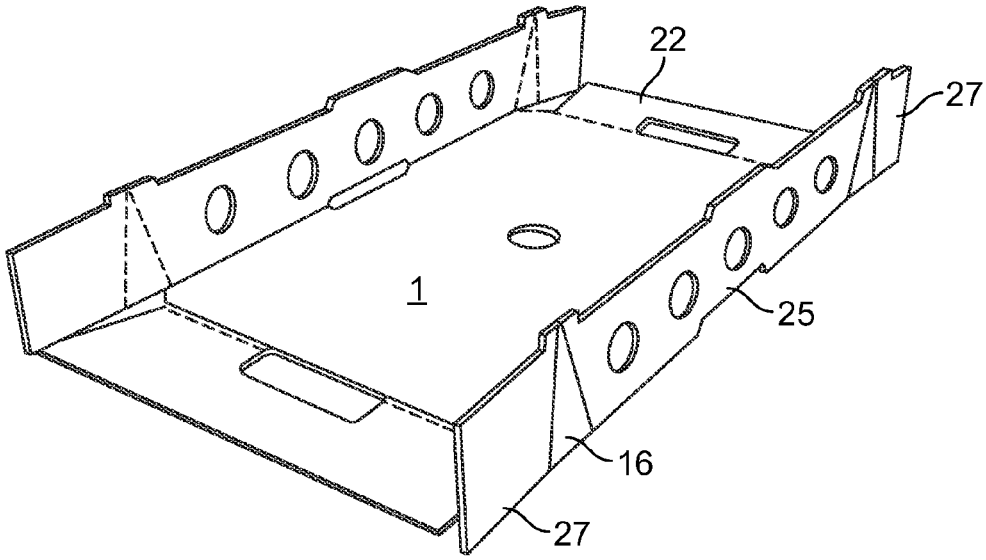
Figure 8:
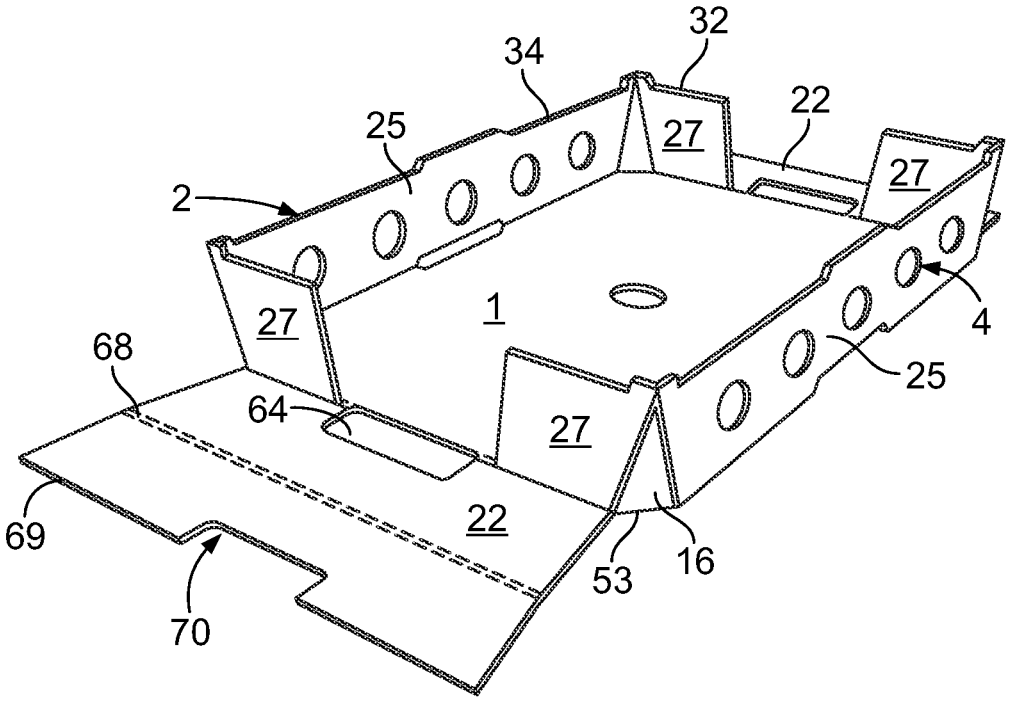
Figure 9:
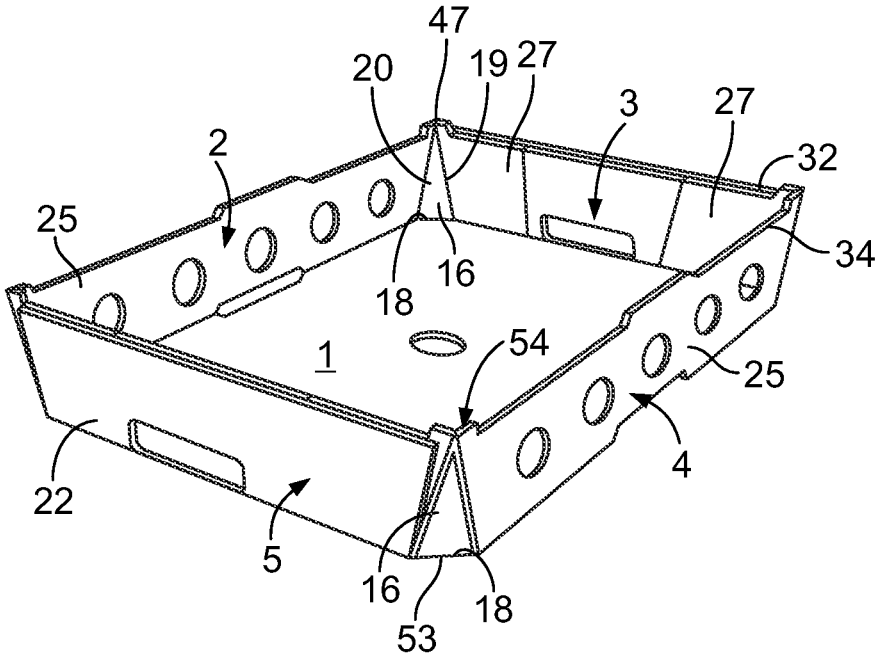

FIG. 5 provides a perspective illustration of a stack of trays made according to a second embodiment;

FIG. 6 shows the cardboard blank from which the tray of FIG. 5 is made;

FIGS. 7 to 9 show the steps for folding the blank of FIG. 6 to obtain the tray of FIG. 5.

Figure 3:
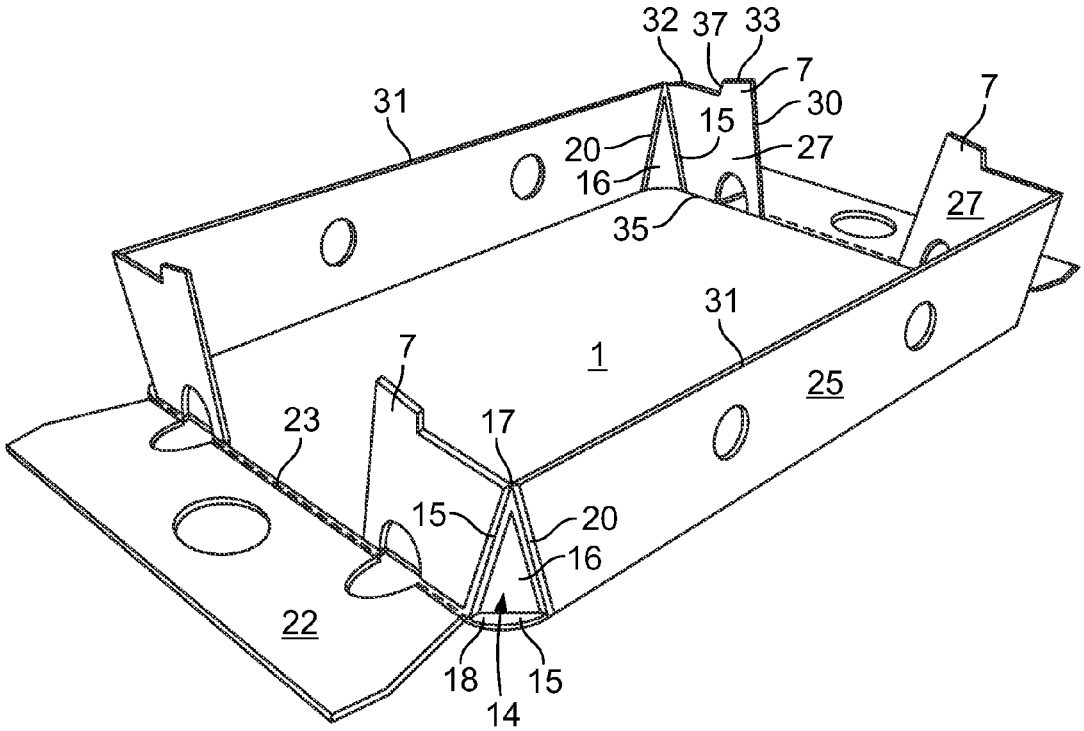
Figure 4:
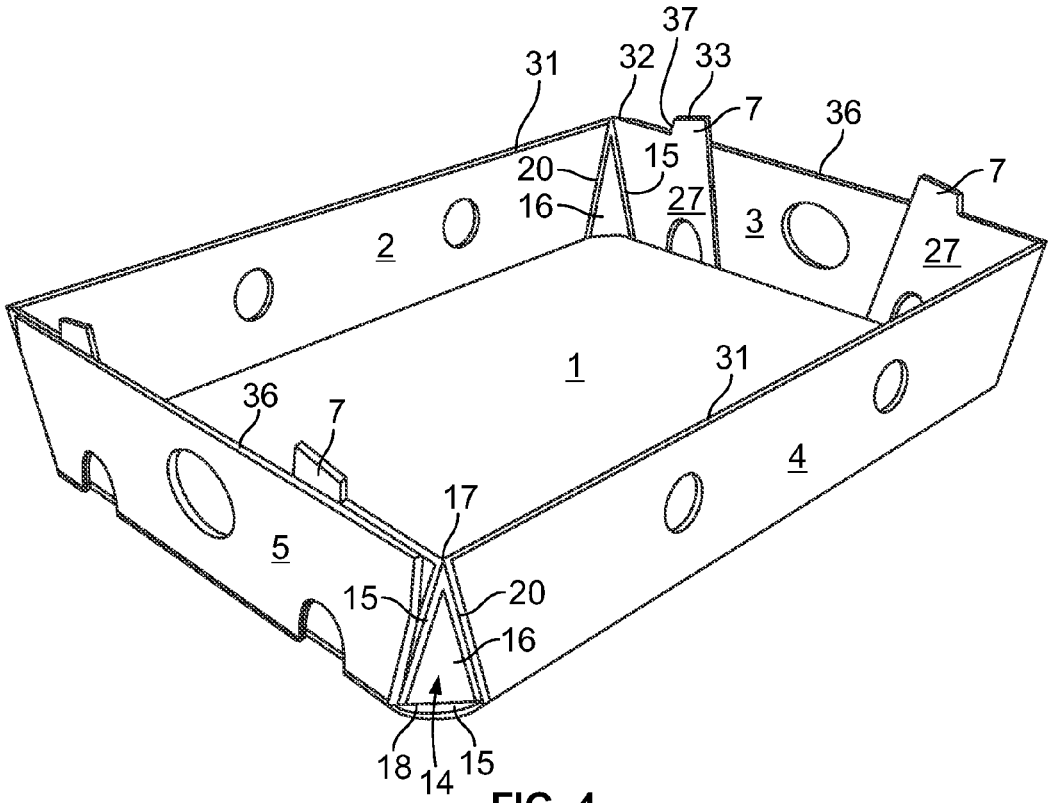
FIG. 4 is a perspective view of the tray made according to the two phases of FIGS. 2 and 3, in the finished state.

With reference to FIG. 3, a tray according to the first embodiment of the invention essentially comprises a bottom wall 1 having a substantially rectangular shape and four side walls 2, 3, 4 and 5 which extend vertically starting from the bottom wall 1, i.e., two parallel opposed side walls 2 and 4 of greater length and two parallel opposed walls of lesser length 3 and 5. The tray is formed by folding a blank of corrugated cardboard having a rectangular shape with appropriate lines for cutting and folding.

Each of the two shorter walls 3, 5 comprises two stacking lugs 7 arranged symmetrically with respect to the median longitudinal axis of the tray and, substantially vertically below each lug 7, an opening 9 enabling the receiving of the stacking lug 7 of the lower tray in the stack formed in this way when several trays are stacked.

Figure 2:
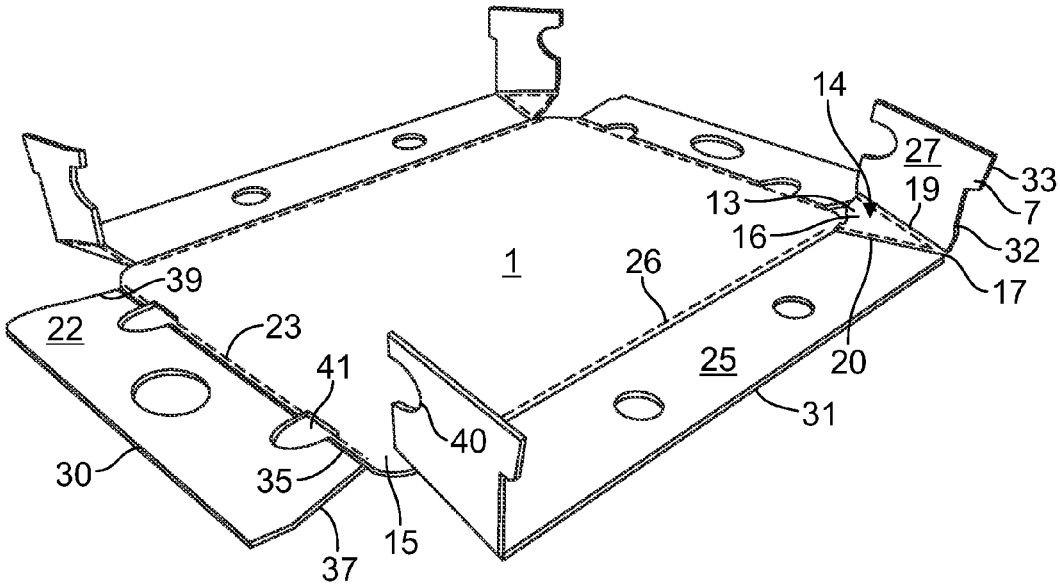
FIGS. 2 and 3 are perspective views in two successive phases of the formation of a tray according to the invention partially reassembled from the blank of FIG. 1.

FIGS. 2 and 3 show a specific configuration at each angle 14. At each of these angled areas, the bottom wall 1 is rounded off at 15 and the two side walls that are adjacent to this interface area 16 form a triangle the apex 17 of which is located at the junction of the upper edges of the walls and the substantially rectilinear base 18 of which is opposite the rounded-off bottom part 15. The base 18 is cut from the bottom wall and joins the two opposing points from the beginning of the rounding which covers an angle of substantially 45°.

It is due to this specific shape of the angles 14 that the stacking lugs 7 fit into the rectangular outline of the initial blank 1 from which the side walls 2 to 4 are obtained through folding.

According to the figures, each of the shorter side walls 3, 5 is formed by a flap 22 that is hingedly connected to the bottom wall 1 along a fold line 23 and has a length that is slightly less than the length of the bottom wall 1.

The two longer walls 2, 4 have a more complex structure and each comprises a main flap 25 joined to the bottom wall 1 by a fold line 26 and, on each side of this main flap 25, a side flap 27 disposed across from a side edge of a flap 22 from which it is separated by a specific cut line 28. Each side flap 27 is joined to the main flap by a triangular interface area which constitutes, when the walls are reassembled, the triangular area 16 of the tray and the lateral lines of which are slanted fold lines 19 and 20. At the time of assembly of the tray, the flaps 27 are adhered to the wall flaps 22 in an inherently known manner.

Figure 1:
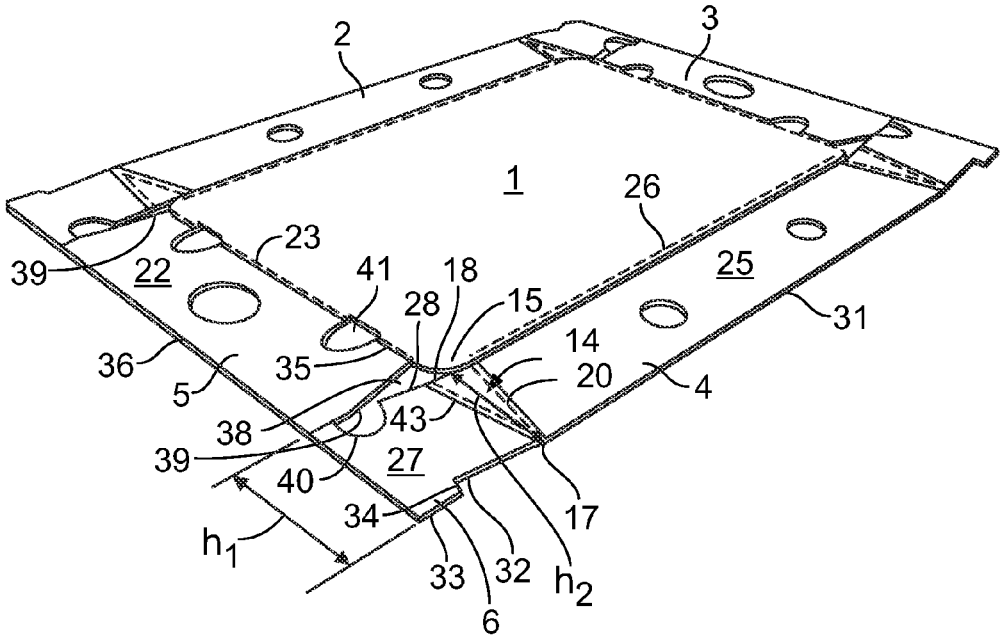
FIG. 1 is a flat perspective view of the initial blank of corrugated cardboard for a tray for transporting and displaying according to a first embodiment of the invention.

With reference to FIG. 1, one can see, more specifically, that the cut line 28 of each side flap 27 separating it from the adjacent side edge of a flap 22 is slanted with respect to the fold line 26 of its main flap 25 so that the flap 27 has a height h1 at its free end, which is greater than the inner height h2, which is to say of the triangular part 16.

It can be seen that the outside edge 32 of a flap 27 which follows the outside edge 31 of its main flap 25 is cut so as to extend from the triangle vertex 17 in a manner substantially parallel to the cut line 28 over a predetermined length and then returns in its part 33 to the free perpendicular outer edge 30 in alignment with the outside edge 31 of the main flap 25. The edge parts 32 and 33 are therefore joined by a relatively short portion of cut line 34. As shown in FIGS. 2 and 3, the part of each flap 27 delimited by the edges 33 and 34 constitutes a stacking lug 7 of a reassembled tray.

The fold lines 19 and 20 of each area of triangular angles 16 and their angle of inclination are selected such that, at the time of the forming of the side walls, which is to say when the main flap 25 is folded around its fold line 26 and each flap 27 is folded along the lines 19 and 20, the rim or the edge 28 comes to rest on the adjacent peripheral area 35 of the bottom 1, as can be seen in FIG. 2. In this figure, it is visible that the free outside edge 32 extends parallel to and at the level of the upper edge 31 of the side wall 25 and the upper edge of the shorter adjacent side wall 3, 5 that has been reassembled by folding on the fold line 23. By contrast, the part of the flap 27 delimited by the edges 33 and 34 protrudes from the upper edge 36 of the corresponding side wall 3, 5, thus forming the stacking lug 7 without protruding beyond the rectangular outline of the initial blank.

To enable the pivoting of the flaps 27, the adjacent side edge 37 of each flap 22 is therefore cut in such a manner that an opening 38 is created in the blank around the rounding 15 of the angle area 14 of the bottom wall 1.

Regarding the cutouts for receiving a stacking lug of another tray below it in a stack, it is formed by an oval cutout 40 in the edge 28 of a flap 27 and 41 in the adjacent flap 22. The cutout 41 extends to the peripheral area 35 of the bottom wall 1. The cutouts 40 and 41 are arranged such that they overlap when the walls are assembled. The positioning of the cutout 40 is such that its median line perpendicular to the edge 28 cuts substantially in the middle of the part forming the lug 7. In this way, each cutout 40, 41 is located in the assembled tray in a substantially vertical position below a lug.

The description of a tray according to the invention that was just provided with reference to the figures shows that the invention offers numerous advantages. First of all, it provides savings of corrugated cardboard to the extent that the parts of the blank that are designed to form the lugs of the tray do not extend beyond the advantageously rectangular outline of the blank. To give the lugs good mechanical strength, the grooves of the corrugated cardboard are oriented in the side walls of which the stacking lugs constitute a part in the direction of compression, which is to say substantially in the direction of the stacking of the trays. The substantially triangular configuration of the angles of the tray and the rounded shape at these places of the bottom wall is also advantageous when the stack of trays is wrapped with plastic wrapping film surrounding the stack.

The fact is also quite considerable that, despite these numerous advantages, the trays can be produced using conventional cutting, folding and adhering techniques with standard existing machines.

As will readily be understood, numerous modifications can be made to the tray that was described above for the sake of example without going beyond the scope of the invention. It is therefore possible to provide the lugs on the long sides of the tray. It is sufficient to this effect to provide the side flaps on the shorter flaps bearing the reference 3 and 5 in the drawings. By modifying the dimensions of the triangular angles of the tray, it is possible to obtain shorter or longer lugs in the direction of their extension beyond the upper edge of the tray.

The embodiment of the tray according to the invention shown in FIGS. 5 to 9 takes up the same general concept of a tray provided with a bottom wall 1 and with side walls 2 to 5 attached to each other by means of a triangular interface area 16 the apex 17 of which points toward the edges 31, 32 of the side walls between which this area 16 is interposed and the base 18 of which rests on the bottom wall 1.

Thus, the tray according to this second embodiment has numerous similarities to that of the first embodiment, giving both improved vertical compressive strength particularly by virtue of the geometry and the positioning of the interface areas 16 of the tray.

These interface areas 16 do in fact extend to the four corners of the tray, and their triangular shape, the base 18 of which is supported on the bottom wall 16 and the apex 17 of which extends to the junction of two consecutive side walls 4 and 5, enables the two walls flanking it to define in their upper part a right angle, which has the consequence, when considered in combination with the base 18 supported on the bottom wall, of opposing the vertical compression exerted by the trays above within a stack.

Moreover, as can be seen particularly in FIG. 5, which shows a stack of trays, the interface area 16 is inclined with respect to the bottom wall, not at 90° as the side walls 2 to 5 are, but at a greater angle which is such that this triangular area diverges from its base 18 to the apex 17 out of the outline defined by the bottom wall 1, even though the side walls 4, 5 that surround it are substantially perpendicular to this bottom wall 1.

This inclination is advantageously used to arrange at each interface area a stacking lug which constitutes the major difference from the tray according to the first embodiment, which had a provision that the lug extend on a side wall of the tray.

More specifically, according to this second embodiment as shown on the lower tray in the stack in FIG. 5, we first chose to cut the portion of the bottom wall 1 on which the base 18 of the interface area 16 rests following a beveled edge 53 which follows this base 18.

This beveled cut 53 makes it possible to free up a space directly below the apex 17 of the inclined interface area 16, within which space the lug of an identical tray below can extend.

Furthermore, this lug 54 has a specific shape due to the fact that it is arranged at the interface area 16 and therefore at the angle formed by two consecutive walls 4 and 5 in FIG. 5.

For this purpose, the lug 54 is made up of two perpendicular sections 56 and 57, each with a height of approximately 7 mm and a width of 1 cm, which extend respectively in the extension of the side walls 4 and 5 and meet at the apex 17 of the interface area.

Each section 56, 57 has a beveled side edge 58 that is parallel to the adjacent hinged edge 19, 20 of the interface area 16 so that the side edges 58 of the lug 54 of a lower tray come into contact both with the beveled edge 53 of the bottom wall 1 of the upper tray and with the interface area 16 of this upper tray.

Thus, each lug 54 of a tray holds, with its inclined sections 58, the beveled edges 53 and the interface areas 16 of a tray above in two directions at the same time.

As a result, all of the lugs of a tray hold a tray above practically without any lateral movement.

Moreover, to further improve the stability of a stack of trays, the longer walls 2 and 4 of a tray are provided with central lugs 60 which extend on the plane of these walls 2 and 4 over a width of approximately 5 cm and directly below which are provided complementary notches 61 made at the junction between the side wall 2, 4 in question and the bottom wall 1.

What is more, to facilitate the gripping of such a tray, the shorter walls 3 and 5 are provided with cutouts 64 having a substantially rectangular shape and which are made from the lower edge of the side wall 3, 5 in question and above which a grip strip 66 is defined for a user made up of the part of the flap not removed.

The user can thus apply the palm of his hand against the edge 32 of each short wall 3, 5 and slide his fingers within the underlying cutout 64 in order to grab the tray.

Moreover, to reinforce the rigidity of this grip strip 66, a provision is made, as illustrated in FIG. 8, that each short wall 3, 5 has a double thickness of blank resulting from the folding of a double side flap onto itself. This flap comprises a double fold line 68 separating it into two semi-flaps hingedly connected to each other, and the closer of the two to the bottom wall 1 is hingedly connected thereto and comprises the abovementioned cutout 64, whereas the semi-flap further from the bottom wall 1 comprises along its free edge 69 opposed to the bottom wall a rectangular-shaped recess 70 complementary in shape to the cutout 64. When this outside semi-flap is applied against the inside semi-flap, the recess 70 closely follows the outline of the cutout 64 and the grip strip 66 has a double thickness of cardboard.

Of course, in order for these short walls 3 and 5 to be able to define the grip strip 66, the upper edge of the cutout 66 must be separated from the upper edge 32 of the wall 3, 5 by a small enough distance so that the user's fingers reach the rectangular cutouts 64 while his palm rests on the edge 32.

Furthermore, orifices 71 for the aeration and visibility of the product can be provided in the long walls 2, 4 and along them. Substantially circular orifices are shown in FIGS. 5 to 9, but for long walls of greater height, these holes can take the form of an oblong aperture extending in one vertical direction.

In this case of higher long walls 2, 4, a provision is of course made that the interface areas 16 and the side flaps 27 have the same greater height, since these interface areas 16 and this flap 27 come from the same part of the blank, which enables the formation of the flap 25 intended to form the wall 2.

As with the abovementioned first embodiment, the tray according to this second embodiment is obtained from a cardboard blank as shown in FIG. 6 which is provided with a central part intended to form the bottom wall 1 and with two long flaps 25 hingedly connected to the long sides of the bottom wall.

Each long flap 25 is further flanked beyond each of these side edges by an interface area 16 and a side attachment flap 27.

But unlike the previous embodiment, the width $h_3$ of the long flap 25 is substantially equal to that of the side flap 27, and the height $h_4$ of the interface area 16 is greater than the width $h_3$ of the long flap 25 and of the attachment flap 27 so that the part of the blank extending on either side of the apex 17 of this interface area can act as a lug.

Thus, in this embodiment, it was not necessary to provide the lower edge of the side flap 27 with an inclination enabling the insertion of the lug 7 into the rectangular outline of the blank as required with the first embodiment.

This blank is shaped by:

- folding the long flaps 25 as well as of the interface areas 16 into an erect position perpendicularly with respect to the bottom wall as illustrated in FIG. 7, then
- folding the interface areas 16 along the underlying beveled edges 53 of the bottom wall 1 according to FIG. 8, at the same time as the folding of the side flaps 27 along the short sides of the bottom wall 1, and finally
- straightening the short flaps 22 to their perpendicular position with respect to the bottom wall and attaching these short flaps 22 to the side flaps 27 to form the short walls 5 and 3 as shown in FIG. 9.

Thus formed, the tray according to the second embodiment of the invention has four lugs arranged at reinforced places of the tray, which is to say at the angles of the tray and supported by triangular interface areas which increase the vertical compressive strength of the tray.

The invention claimed is:

1. Tray for transporting and displaying items such as yogurt containers, obtained by folding a blank of corrugated cardboard having a rectangular shape, of the type comprising a bottom wall having a rectangular outline (1) and attachment flaps (27) providing the attachment of a first end wall (2, 4) to the adjacent, respective side wall (3, 5), each attachment flap (27) being hingedly connected to the side edge of the first end wall (2, 4) and attached to the adjacent side wall (3, 5), characterized in that the hinged connection of an attachment flap (27) to a first end wall (2, 4) is provided by an interface area (16) interposed between two consecutive side and end walls (2, 3), (4, 5), the area (16) being in the shape of a triangle the apex (17) of which points toward a free upper edge (31, 32) of the two consecutive side and end walls (2, 3), (4, 5) and the base (18) of which rests on the bottom wall (1), the triangular interface area (16) being inclined from the base (18) to the apex (17) toward the outside of the outline defined by the bottom wall (1) and further characterized in that the tray comprises stacking lugs (54) each extending above the interface area (16), a portion of the bottom wall (1) on which the interface area (16) rests being cut along the base (18) of the interface area (16) so as to leave a receiving space free for a stacking lug of a second, underlying tray.

2. Tray as set forth in claim 1, characterized in that each stacking lug (54) is formed by a part of the blank extending beyond the interface area (16) on either side of the apex (17) of interference area (16), the part of the blank defining two perpendicular cardboard sections (56, 57) extending respectively in an extension of the two consecutive side walls (2, 3, 4, 5) between which the interface area (16) is interposed.

3. Tray as set forth in claim 2, characterized in that a free side edge (58) of each section (56, 57) of the lug (54) is parallel to the adjacent lateral side (19, 20) of the triangular interface area (16) so as to enable application against the interface area (16) of an identical second tray above said tray within a stack.

4. Tray as set forth in claim 3, characterized in that the side walls (3, 5) are shorter than the end walls (2, 4) and the two shorter opposed side walls (3, 5) each comprises a cutout (64) made in the lower part of the side wall (3, 5), the lower part of the side wall (3, 5) arranged above the cutout serving as a grip strip (66) for a user.

5. Tray as set forth in claim 4, characterized in that the grip strip (66) of each shorter side wall (3, 5) comprises a double thickness of blank and is derived from the folding onto itself of a second flap for forming said side wall, which comprises a double fold line (68), the sidewall and flap forming two parts, and the two parts of which extending from each side of the double line are provided with grip cutouts (64, 70) which match each other when the flap is folded onto the sidewall.

6. Tray as set forth in claim 5, characterized in that the cutout (64, 70) is formed from the lower edge of the short sidewall (3, 5).

7. Tray as set forth in claim 6, characterized in that end walls (2,4) are longer than the end walls (3,5) and the two longer opposed end walls of the tray (2, 4) are provided with second lugs (60) extending above a plane of these longer walls (2, 4) and with complementary notches (61) made directly below each lug (60) within the end wall (2, 4) and the bottom wall (1).

8. Tray as set forth in claim 7, characterized in that the longer end walls (2, 4) comprise on their length openings for the visibility and aeration of the products (71).

9. Tray as set forth in claim 8, characterized in that the two longer end walls (2, 4), the attachment flaps (27) attaching the longer end walls (2, 4) to the shorter side walls (3, 5) and the interface areas (16) have the same height, said height being greater than that of the short walls (3, 5).

10. Tray as set forth in claim 1, characterized in that the tray comprises stacking lugs (7) each formed on the attachment flap (27) providing the attachment of adjacent walls (2, 4; 3, 5).

* * * * *